US006325483B1

(12) United States Patent
Harbour et al.

(10) Patent No.: US 6,325,483 B1
(45) Date of Patent: Dec. 4, 2001

(54) TECHNIQUES FOR INCREASING INK-JET PEN IDENTIFICATION INFORMATION IN AN INTERCONNECT LIMITED ENVIRONMENT

(75) Inventors: Robert Harbour, Gilbert, AZ (US); Matthew A. Shepherd, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/619,113

(22) Filed: Jul. 19, 2000

(51) Int. Cl.[7] ..... B41J 29/393; B41J 29/38
(52) U.S. Cl. ..... 347/19; 347/14
(58) Field of Search ..... 347/19, 5, 49, 347/50, 14, 12, 10, 11

(56) References Cited

U.S. PATENT DOCUMENTS

| | | | | |
|---|---|---|---|---|
| 4,872,027 | | 10/1989 | Buskirk et al. | 347/19 |
| 5,363,134 | * | 11/1994 | Barbehenn et al. | 347/49 |
| 5,504,507 | | 4/1996 | Watrobski et al. | 347/19 |
| 5,699,091 | | 12/1997 | Bullock et al. | 347/19 |
| 5,831,649 | | 11/1998 | Watrobski et al. | 347/19 |

* cited by examiner

*Primary Examiner*—John Barlow
*Assistant Examiner*—Charles W. Stewart, Jr.

(57) ABSTRACT

Multiple links with series resistors are connected to address select transistors and a sense line in a printhead encoding circuit. This arrangement provides an increased number of possible states, thereby increasing the amount of information which can be encoded for such purposes as pen identification.

9 Claims, 2 Drawing Sheets

TECHNIQUES FOR INCREASING INK-JET PEN IDENTIFICATION INFORMATION IN AN INTERCONNECT LIMITED ENVIRONMENT

TECHINICAL FIELD OF THE INVENTION

This invention relates to ink-jet printing, and more particularly to techniques for providing pen identification information.

BACKGROUND OF THE INVENTION

Identification bits are useful in an ink-jet pen, e.g. a thermal ink-jet pen, to identify the pen model, ink color, ink fill and other parameters. Electrical interconnects are used to read this identification from the standard pen electrical interface. The number of interconnections is limited by cost and available space on the printhead die.

The typical technique for encoding information is illustrated in FIG. 1, and uses a single low resistance connection or link 12A–12N for each printhead address bit A(O), A(1). . . A(N), connecting each address select transistor 10A, 10B . . . 10N to a common "sense" line 14 through a resistance 16A, 16B . . . 16N. Information is stored by connecting or not connecting each of these links 12A–12N. Since there are only two possible states for this link, the number of possible states is $2^N$ possible states. The information is read by a resistance measurement on the sense line.

It would be an advantage to be able to store and access more information per interconnect than is provided by existing techniques.

SUMMARY OF THE INVENTION

In accordance with an aspect of the invention, multiple links with series resistors are connected to address select transistors and a sense line in a printhead encoding circuit. In an exemplary embodiment, this arrangement provides $2^{(\#links \times N\ address\ lines)}$ possible states.

In an exemplary embodiment, the printhead data encoding circuit includes a sense line, and a plurality of addressable circuits connected between the sense line and a common connection or reference voltage, such as ground. Each addressable circuit includes a select device and a parallel connection of a plurality of link elements and corresponding resistive elements. Information is encoded by connecting or not connecting the link elements to affect the resistance through the parallel connection.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
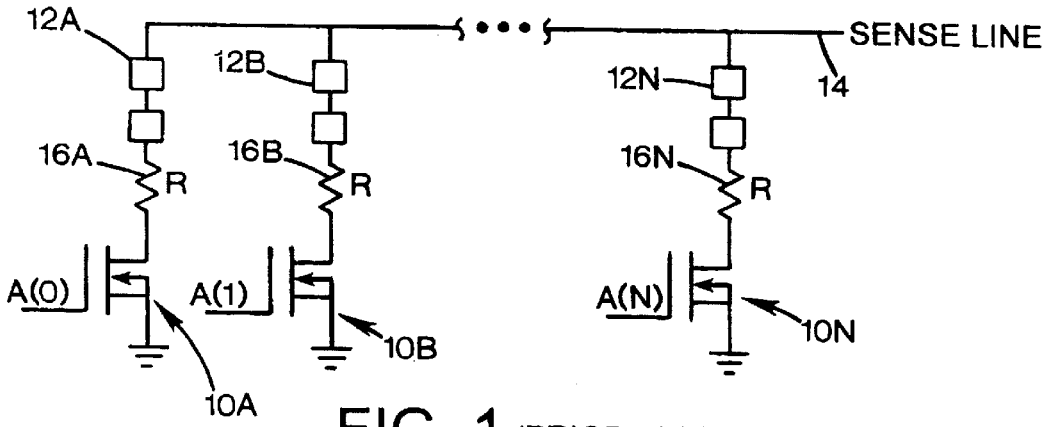
FIG. 1 (PRIOR ART)
FIG. 1 is a schematic diagram illustrating a known technique for encoding information for an ink-jet printhead.
Figure 2:
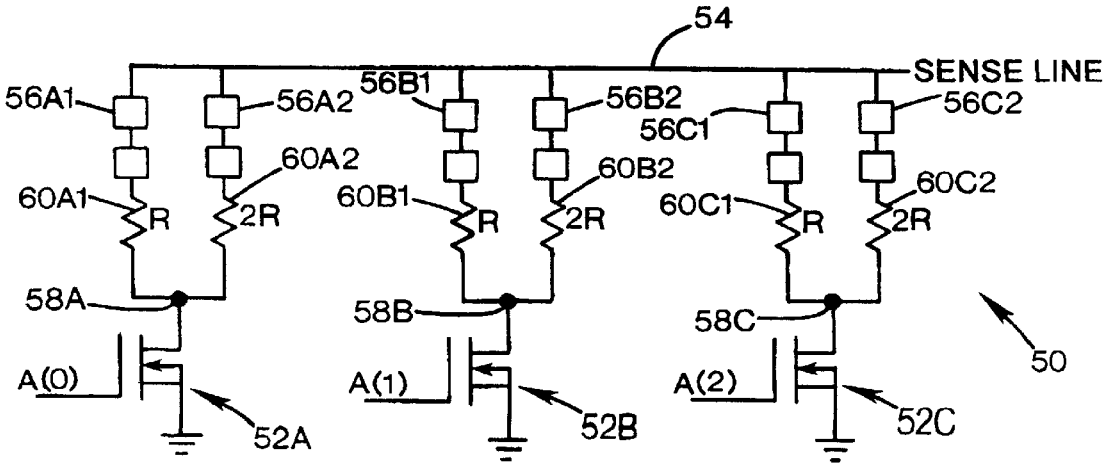
FIG. 2 is a schematic diagram illustrating a circuit for encoding printhead information in accordance with the invention.

An exemplary printhead encoding circuit 50 is shown in FIG. 2, and employs two links and resistors on each of three address select transistors, with resistor values in multiples of 2. Thus, the respective series connections of link 56A1 and resistor 60A1, and link 56A2 and resistor 60A2, are connected in parallel between the sense line 54 and common node 58A, which in turn is connected through address select transistor 52A to a common reference, in this case to ground. The respective series connections of link 56B1 and resistor 60B1, and link 56B2 and resistor 60B2, are connected in parallel between the sense line 54 and common node 58B, which in turn is connected through address select transistor 52B to ground. The respective series connections of link 56C1 and resistor 60C1, and link 56C2 and resistor 60C2, are connected in parallel between the sense line 54 and common node 58C, which in turn is connected through address select transistor 52C to ground.

Instead of connecting the addressable circuits to ground, the circuits can be connected to a common node or common reference, e.g. a common reference voltage.

The resistors 60A1, 60B1 and 60C1 have resistance values R, and the resistors 60A2, 60B2 and 60C2 have resistance values 2R. In one exemplary implementation, R has a value of 40 ohms, although the resistance for a particular application will depend on the fabrication process, the type of fusible link, and is in general a function of the energy needed to blow the fuse.

The links 56A1–56C2 can be connected or not connected, depending on the particular encoded information value. The encoded data is read by a resistance measurement on the sense line. This can be done by passing a constant known current on the sense line 54 and measuring the voltage, or by applying a known voltage on the sense line and measuring the current drawn through the sense line, for each of the address select lines. The measurement can be accomplished by use of an analog-to-digital converter (ADC) or comparator circuit, depending on the number of links and the particular application. For the example shown in FIG. 2, the measurement circuit need only detect four states, i.e. a state with both links unconnected, the states with only one or the other of the links unconnected, and the state with both links connected. Since a comparator circuit compares the signal voltage to a threshhold or reference voltage level, detecting the three states using comparator devices would require at least two comparator circuits. Typically, most applications will have ADC capability available for this purpose, and use of the ADC will be the preferred approach to read the encoded data. The resistance values for an exemplary selected address line are indicated in the following table, with "C" and "NC" indicating that a link is connected or not connected, and "A" and "B" indicating the respective links in the selected address line.

| A | B | Resistance to ground on the sense line |
|---|---|---|
| C | C | 2/3R |
| C | NC | R |
| NC | C | 2R |
| NC | NC | Infinity |

Thus, for the case of two links and resistors per address select line, there are four possible resistance states for the arrangement illustrated in FIG. 2. Thus, this exemplary implementation has increased the number of possible states from 2 per address select line to 4 per address select line.

The number of links and resistors per address line is not limited to two, and thus to further increase the number of possible states, three, four or more links and resistors in series could be employed. The resistance values for the system should be selected in such a way that the measurement circuit, e.g. an ADC, will be able to differentiate the values for the different states, and while still being able to disconnect the fuses associated with the largest resistor fuses The links can be connected or disconnected using conventional techniques. For example, the links can comprise fusible links which can be selectively disconnected during a programming operation, wherein a current drive through the selected address select line is sufficient to "blow" the fuse. The current drive is selected in dependence on the desired link pattern, since the parallel connection with the lowest resistance value is "blown" first, then the parallel connection with the next lowest resistance value, and so on. This technique allows the circuit 50 to be programmed after fabrication, and so is particularly useful to program information which is not known until after printhead fabrication. Alternatively, the links can be fabricated in the desired arrangement during a fabrication process using photolithographic etching techniques to selectively remove a link conductor. This latter technique is particularly useful to program information known prior to printhead fabrication. The circuit 50 could also be programmed using a combination of these techniques, so that some bits are programmed during the fabrication process, and some bits are programmed subsequent to printhead fabrication.

To maintain control over the fuse-blowing process, there should be some separation in the resistance values. When adding resistances in parallel, one exemplary set of resistance values is R, 2R, 4R, 8R, 16R . . . , i.e. adding resistances by a factor of two. For the example of three parallel links, when blowing one fuse, the remaining resistance values will be 2R and 4R, resulting in a parallel resistance of 4/3R. The resulting resistance values will be considered when determining the ADC resolution; e.g., a 16 bit ADC may be needed for an 8 link system.

Figure 3:
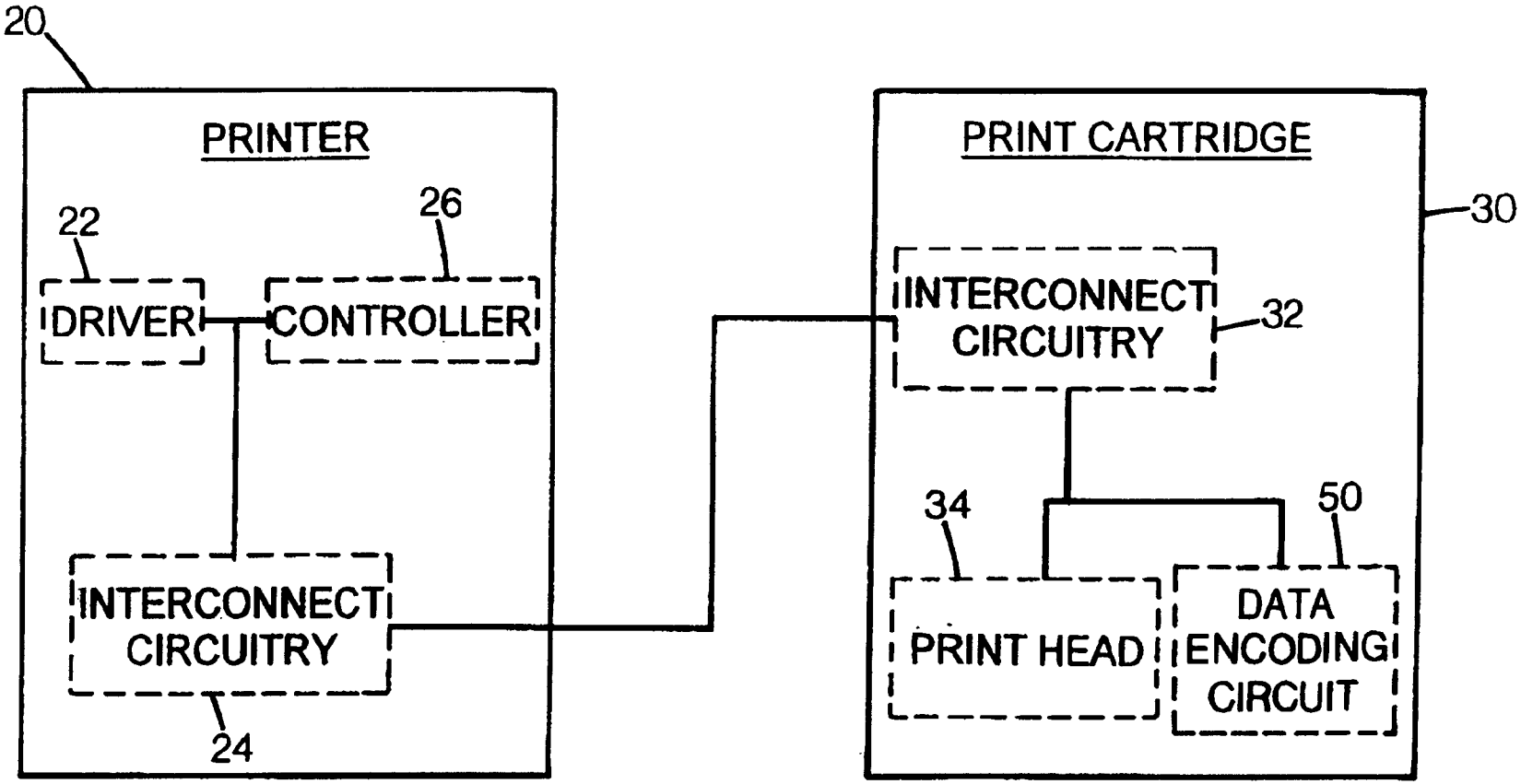
FIG. 3 diagrammatically illustrates a technique for reading information stored by a printhead data encoding circuit in accordance with the invention.

In a typical ink-jet cartridge implementation, the data encoding circuit 50 is fabricated on the printhead substrate which carries the ink firing resistors. The firing resistors and the circuit 50 are electrically connected by circuit traces on a TAB circuit carrying the printhead substrate. FIG. 3 diagrammatically illustrates a technique for reading information stored by the data encoding circuit 50. A printer 20 is electrically connected to a print cartridge 30 through corresponding interconnect circuitry 24 and 32. The printer interconnect circuitry 24 can be mounted on a carriage in which is removably mounted the cartridge 30, such that when the cartridge is mounted in the carriage, corresponding pads of interconnect circuitry 24 are in physical and electrical contact with pads of interconnect circuit 32. The interconnect circuitry 24 is connected to the driver 22 and controller 26 of the printer. Of course the driver 22 and printer controller 26 can be fabricated on an ASIC in an exemplary application.

The print cartridge 30 includes a printhead 34 with one or more nozzle arrays and with printhead firing resistors. In a typical implementation, the printhead 34 and the data encoding circuit 50 are fabricated on a printhead substrate, and electrically connected to the interconnect circuitry 32 by conventional techniques. The controller 26 can interrogate the data encoding circuit 50 by providing appropriate address select signals to the circuit 50 and performing a resistance measuring process to determine the resistance between the sense line and ground for the circuit 50. This is repeated for each address select line.

The disclosed technique allows additional identification and characterization information to be stored in a printhead or ink-jet cartridge without adding the expense of additional interconnection resources. Moreover, the technique is compatible with existing printhead driver ASICs for reading this data back from the printhead or cartridge. The link and series resistors are compatible with known production techniques.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink-jet print cartridge, including:

a printhead with one or more nozzle arrays fabricated on a printhead substrate with printhead firing resistors;

a printhead data encoding circuit, comprising:

a sense line:

a plurality of addressable circuits connected between the sense line and a common reference, each circuit comprising a select device, an address line connected to the select device, and a parallel connection of a plurality of link elements and corresponding resistive elements, whereby information is encoded by connecting or not connecting the link elements;

interconnect circuitry coupled to the printhead and to the data encoding circuit to provide printhead drive signals and to interrogate the data encoding circuit.

2. The print cartridge of claim 1 wherein said resistive elements of said parallel connection have different resistance values.

3. The print cartridge of claim 1 wherein said plurality of link elements and corresponding resistive elements include a first link element in series with a first resistive element, and a second link element in series with a second resistive element.

4. The print cartridge of claim 3 wherein said first resistive element has a first resistance value, and said second resistive element has a second resistance value, and wherein said second resistance value is nominally twice said first resistance value.

5. The print cartridge of claim 1 wherein the select device is a transistor.

6. The print cartridge of claim 1 wherein the plurality of link elements includes a fusible link which is fabricated in a connected state, and which can be opened during a post-fabrication programming process.

7. The print cartridge of claim 1 wherein the plurality of link elements includes a link fabricated in the desired connected or not connected state to program information known prior to printhead fabrication.

8. The print cartridge of claim 1 wherein there are N of said plurality of addressable circuits, each including an address line and M link elements, and said plurality of addressable circuits provides $2^{(M\times N)}$ possible states.

9. The print cartridge of claim 1 wherein the common reference is ground.

* * * * *